US012049291B2

(12) United States Patent
Nishimura et al.

(10) Patent No.: US 12,049,291 B2
(45) Date of Patent: Jul. 30, 2024

(54) OUTBOARD MOTOR AND LUBRICATING OIL INTRODUCING METHOD THEREOF

(71) Applicant: HONDA MOTOR CO., LTD., Tokyo (JP)

(72) Inventors: Kenta Nishimura, Saitama (JP); Nobuo Uesaka, Saitama (JP); Takahiro Ataku, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 407 days.

(21) Appl. No.: 17/497,581

(22) Filed: Oct. 8, 2021

(65) Prior Publication Data

US 2022/0177099 A1 Jun. 9, 2022

(30) Foreign Application Priority Data

Dec. 4, 2020 (JP) ..... 2020-201443

(51) Int. Cl.

| | |
|---|---|
| ***B63H 20/00*** | (2006.01) |
| ***B63H 20/14*** | (2006.01) |
| ***B63H 20/28*** | (2006.01) |
| ***B63H 20/32*** | (2006.01) |
| ***B63H 23/06*** | (2006.01) |
| ***B63H 23/34*** | (2006.01) |

(52) U.S. Cl.

CPC ..... *B63H 20/002* (2013.01); *B63H 20/14* (2013.01); *B63H 20/285* (2013.01); *B63H 20/32* (2013.01); *B63H 23/06* (2013.01); *B63H 23/34* (2013.01); *B63H 2020/323* (2013.01)

(58) Field of Classification Search

CPC .... B63H 20/002; B63H 20/14; B63H 20/285; B63H 20/32; B63H 23/06; B63H 23/34; B63H 2020/323

See application file for complete search history.

(56) References Cited

U.S. PATENT DOCUMENTS

| | | | | |
|---|---|---|---|---|
| 8,267,732 | B1 | 9/2012 | Poirier et al. | |
| 9,227,715 | B1 * | 1/2016 | Raetzman | B63H 20/285 |
| 9,937,989 | B2 * | 4/2018 | Kumita | B63H 20/10 |

* cited by examiner

*Primary Examiner* — Anthony D Wiest

(74) *Attorney, Agent, or Firm* — Armstrong Teasdale LLP

(57) ABSTRACT

An outboard motor includes: a driveshaft housing configured to accommodate a driveshaft; and a gear case bulging laterally below the driveshaft housing and configured to accommodate a gear device, wherein an inside of the driveshaft housing communicates with an inside of the gear case, an introduction port for introducing lubricating oil into the gear case is opened on the driveshaft housing, and a confirmation port for causing the lubricating oil introduced into the gear case to flow out is opened on a front end side of the gear case.

9 Claims, 5 Drawing Sheets

OUTBOARD MOTOR AND LUBRICATING OIL INTRODUCING METHOD THEREOF

TECHNICAL FIELD

The present invention relates to an outboard motor and a lubricating oil introducing method thereof.

BACKGROUND ART

Conventionally, an outboard motor includes an engine including a rotatable crankshaft, a driveshaft configured to rotate according to rotation of the crankshaft, a propeller shaft configured to rotate according to rotation of the driveshaft, a gear device configured to transmit the rotation of the driveshaft to the propeller shaft, a driveshaft housing configured to accommodate the driveshaft, and a gear case configured to accommodate the gear device. For example, the engine is a vertical engine provided with the crankshaft extending vertically. A shift position of the gear device is switched between "forward", "reverse", and "neutral". A rotation axis of the propeller shaft extends horizontally, and a propeller is fixed to an end of the propeller shaft.

Generally, the above gear device consists of metal gears. In order to prevent abnormal wear and abnormal noise during rotation of the metal gears, lubricating oil is normally introduced into the gear case. Further, the above driveshaft is provided with a water pump for sending cooling water from an outside of the outboard motor to the engine, and is supported by bearings. Generally, the bearings are lubricated by the lubricating oil introduced into the gear case.

For example, U.S. Pat. No. 8,267,732 discloses one introducing method (hereinafter referred to as "the first introducing method") for the lubricating oil as a conventional technique. In the first introducing method, the lubricating oil is introduced from an introduction port provided at a lower portion of the gear case until the lubricating oil flows out from a confirmation port provided at the driveshaft housing. Further, U.S. Pat. No. 8,267,732 discloses another introducing method (hereinafter referred to as "the second introducing method") for the lubricating oil as an embodiment. In the second introducing method, the lubricating oil is introduced from an introduction port provided at a lower portion of the gear case until the lubricating oil flows out from a confirmation port provided at an upper portion of the gear case.

However, in the first and second introducing methods, the introduction port is arranged lower than the confirmation port. Accordingly, when the lubricating oil is introduced, a mechanism (for example, a pump) for sending the lubricating oil from a lower side to an upper side is required. Thus, an introducing operation of the lubricating oil may be complicated, and the required time thereof may be lengthened. Further, the lubricating oil may leak from the introduction port in a period after completing the introduction of the lubricating oil and before closing the introduction port. Accordingly, an appropriate amount of the lubricating oil may not be introduced into the outboard motor.

Further, in the above first introducing method, the lubricating oil is introduced into the whole gear case and a portion of the driveshaft housing, and thus the whole gear device and a portion of the driveshaft are submerged by the lubricating oil. As a result, when the metal gears of the gear device and the driveshaft rotate, the frictional resistance (viscous resistance) due to the lubricating oil increases, which may cause the decrease in the output of the engine. Further, in the above second introducing method, it is necessary to remove the propeller so as to open the introduction port and the confirmation port provided in the vicinity of the propeller. Accordingly, the introducing operation of the lubricating oil may be further complicated, and the required time thereof may be further lengthened.

SUMMARY OF THE INVENTION

In view of the above background, an object of the present invention is to provide an outboard motor and a lubricating oil introducing method therefor that can easily and quickly introduce an appropriate amount of lubricating oil into the outboard motor.

To achieve such an object, one aspect of the present invention provides an outboard motor (1) including: a drive device (8) including a rotatable driving shaft (57); a driveshaft (9) extending in an up-and-down direction below the drive device and configured to rotate according to rotation of the driving shaft; a propeller shaft (10) extending horizontally below the driveshaft and configured to rotate according to rotation of the driveshaft; a propeller (11) fixed to the propeller shaft; a gear device (12) provided between the driveshaft and the propeller shaft and configured to transmit the rotation of the driveshaft to the propeller shaft; a driveshaft housing (20) configured to accommodate the driveshaft; and a gear case (21) bulging laterally below the driveshaft housing and configured to accommodate the gear device, wherein an inside of the driveshaft housing communicates with an inside of the gear case, an introduction port (44) for introducing lubricating oil into the gear case is opened on the driveshaft housing, and a confirmation port (53) for causing the lubricating oil introduced into the gear case to flow out is opened on a front end side of the gear case.

According to this aspect, the introduction port is arranged higher than the confirmation port, so that the lubricating oil introduced from the introduction port can reach the confirmation port by gravity. Accordingly, when the lubricating oil is introduced, a mechanism (for example, a pump) for sending the lubricating oil from a lower side to an upper side is unnecessary, so that an introducing operation of the lubricating oil can be simplified and the required time thereof can be shortened. Further, by arranging the introduction port higher than the gear case, it is possible to prevent the lubricating oil from leaking from the introduction port in a period after completing the introduction of the lubricating oil and before closing the introduction port. Accordingly, an appropriate amount of the lubricating oil can be introduced into the gear case. Furthermore, by stopping the introduction of the lubricating oil from the introduction port when the lubricating oil flows out from the confirmation port, it is possible to introduce an appropriate amount of the lubricating oil into the gear case without weighing the lubricating oil in advance.

Further, according to the above aspect, the amount of the lubricating oil introduced into the outboard motor can be reduced as compared with a case where the lubricating oil is introduced into the entire gear case and a portion of the driveshaft housing. Accordingly, when gears of the gear device and the driveshaft rotate, the frictional resistance (viscous resistance) due to the lubricating oil can be reduced, and the decrease in the output of the engine can be suppressed. Further, it is possible to perform the introducing operation of the lubricating oil without removing the propeller, so that the introducing operation of the lubricating oil can be further simplified and the required time thereof can be further shortened.

In the above aspect, preferably, a side recess (41) is provided on a side surface of the driveshaft housing, and a water inlet (43) for introducing cooling water is opened inside the side recess, and the introduction port is opened inside the side recess so as to be next to the water inlet.

According to this aspect, since the water inlet and the introduction port are opened inside one recess, it is possible to suppress an increase in the number of recesses formed on the side surface of the driveshaft housing. Accordingly, the water flow outside the outboard motor can be smoothed.

In the above aspect, preferably, the water inlet is covered with a filter (46).

According to this aspect, it is possible to prevent a foreign object from entering the outboard motor during water supply.

In the above aspect, preferably, the gear case is provided with a gear chamber (28) configured to accommodate the gear device, and the confirmation port is arranged higher than an axis (X) of the propeller shaft and lower than an upper end of the gear chamber so as to function as a discharge port for discharging the lubricating oil.

According to this aspect, since the confirmation port functions (doubles) as the discharge port for discharging the lubricating oil, the number of portions to be processed can be reduced as compared with a case where the confirmation port and the discharge port of the lubricating oil are processed separately.

In the above aspect, preferably, a front recess (49) is provided on the front end side of the gear case, and the confirmation port is opened inside the front recess and covered with a cover (55) configured to close the front recess.

According to this aspect, by closing the front recess by the cover, the shape of the front end side of the gear case, which is subject to large water pressure, can be smoothed. Accordingly, the water flow outside the outboard motor can be smoothed.

In the above aspect, preferably, the outboard motor further includes: a shift shaft (76) extending in the up-and-down direction so as to be parallel to the driveshaft; and a shift member (77) configured to switch a shift position of the gear device according to rotation of the shift shaft and including an engagement portion (82) engaging with a lower end of the shift shaft, wherein the driveshaft housing is provided with a first shaft chamber (23) configured to accommodate the driveshaft and a second shaft chamber (26) configured to accommodate the shift shaft, the driveshaft is supported by an upper bearing (24) and a lower bearing (25) that are accommodated in the first shaft chamber, the gear case is provided with a gear chamber (28) configured to accommodate the gear device and a shift chamber (31) configured to accommodate the engagement portion of the shift member, and the driveshaft housing is provided with a first oil passage (P1) extending from the gear chamber and returning thereto via the lower bearing and a second oil passage (P2) extending from the gear chamber and leading to the shift chamber via the lower bearing, the upper bearing, and the second shaft chamber.

According to this aspect, even if the lubricating oil is not introduced up to an upper end of the gear case, the lubricating oil can be sufficiently distributed to the gear chamber, the shift chamber, and the first and second shaft chambers. Accordingly, the members (for example, the gear device, the shift shaft, the shift member, the upper bearing, the lower bearing, and the like) arranged in the gear chamber, the shift chamber, and the first and second shaft chambers can be lubricated quickly and sufficiently.

In the above aspect, preferably, the introduction port communicates with the first shaft chamber, and the confirmation port communicates with the shift chamber.

According to this aspect, the lubricating oil flows out from the confirmation port after a sufficient amount of the lubricating oil is introduced into the gear chamber and the shift chamber. Accordingly, the members arranged in the gear chamber, the shift chamber, and the first and second shaft chambers can be lubricated more effectively.

To achieve such an object, another aspect of the present invention provides a lubricating oil introducing method of an outboard motor (1) including: a drive device (8) including a rotatable driving shaft (57); a driveshaft (9) extending in an up-and-down direction below the drive device and configured to rotate according to rotation of the driving shaft; a propeller shaft (10) extending horizontally below the driveshaft and configured to rotate according to rotation of the driveshaft; a propeller (11) fixed to the propeller shaft; a gear device (12) provided between the driveshaft and the propeller shaft and configured to transmit the rotation of the driveshaft to the propeller shaft; a driveshaft housing (20) configured to accommodate the driveshaft; and a gear case (21) bulging laterally below the driveshaft housing and configured to accommodate the gear device, wherein an inside of the driveshaft housing communicates with an inside of the gear case, an introduction port (44) for introducing lubricating oil into the gear case is opened on the driveshaft housing, and a confirmation port (53) for causing the lubricating oil introduced into the gear case to flow out is opened on a front end side of the gear case, the lubricating oil introducing method including: opening the introduction port and the confirmation port; introducing the lubricating oil from the introduction port; stopping introduction of the lubricating oil from the introduction port after confirming that the lubricating oil flows out from the confirmation port; and closing the confirmation port.

According to this aspect, by arranging the introduction port higher than the confirmation port, the lubricating oil introduced from the introduction port reaches the confirmation port by gravity. Accordingly, when the lubricating oil is introduced, a mechanism (for example, a pump) for sending the lubricating oil from a lower side to an upper side becomes unnecessary, so that an introducing operation of the lubricating oil can be simplified and the required time thereof can be shortened. Further, by arranging the introduction port higher than the gear case, it is possible to prevent the lubricating oil from leaking from the introduction port in a period after completing the introduction of the lubricating oil and before closing the introduction port. Accordingly, an appropriate amount of the lubricating oil can be introduced into the gear case. Furthermore, by stopping the introduction of the lubricating oil from the introduction port when the lubricating oil flows out from the confirmation port, it is possible to introduce an appropriate amount of the lubricating oil into the gear case without weighing the lubricating oil in advance.

Further, according to the above aspect, the amount of the lubricating oil introduced into the outboard motor can be reduced as compared with a case where the lubricating oil is introduced into the entire gear case and a portion of the driveshaft housing. Accordingly, when gears of the gear device and the driveshaft rotate, the frictional resistance (viscous resistance) due to the lubricating oil can be reduced, and the decrease in the output of the engine can be suppressed. Further, the introducing operation of the lubricating oil can be performed without removing the propeller, so that the introducing operation of the lubricating oil can be further simplified and the required time thereof can be further shortened.

In the above aspect, preferably, introducing the lubricating oil from the introduction port in a state where the outboard motor is tilted.

According to this aspect, it is possible to adjust or limit the amount of the lubricating oil introduced into the gear case by using a simple method.

In the above aspect, preferably, the lubricating oil introducing method further including: setting a recommended tilt angle of the outboard motor before introducing the lubricating oil from the introduction port, and controlling a tilt angle of the outboard motor such that the tilt angle of the outboard motor matches the recommended tilt angle of the outboard motor before introducing the lubricating oil from the introduction port.

According to this aspect, a worker can tilt the outboard motor at an appropriate angle without tilting the outboard motor by himself/herself. Accordingly, the introducing operation of the lubricating oil can be simplified.

Thus, according to the above aspects, it is possible to provide an outboard motor and a lubricating oil introducing method therefor that can easily and quickly introduce an appropriate amount of lubricating oil into the outboard motor.

BRIEF DESCRIPTION OF THE DRAWING(S)

DESCRIPTION OF THE PREFERRED EMBODIMENT(S)

<Configuration of Outboard Motor 1>

In the following, the configuration of an outboard motor 1 according to an embodiment of the present invention will be described with reference to the drawings. In the following, directional terms such as front, rear, upper, lower, left, and right will be used based on a state where the outboard motor 1 is not tilted (see FIGS. 1 to 4). Arrows Fr, Re, U, and Lo attached to each figure indicate a front side, a rear side, an upper side, and a lower side of the outboard motor 1, respectively.

Figure 1:
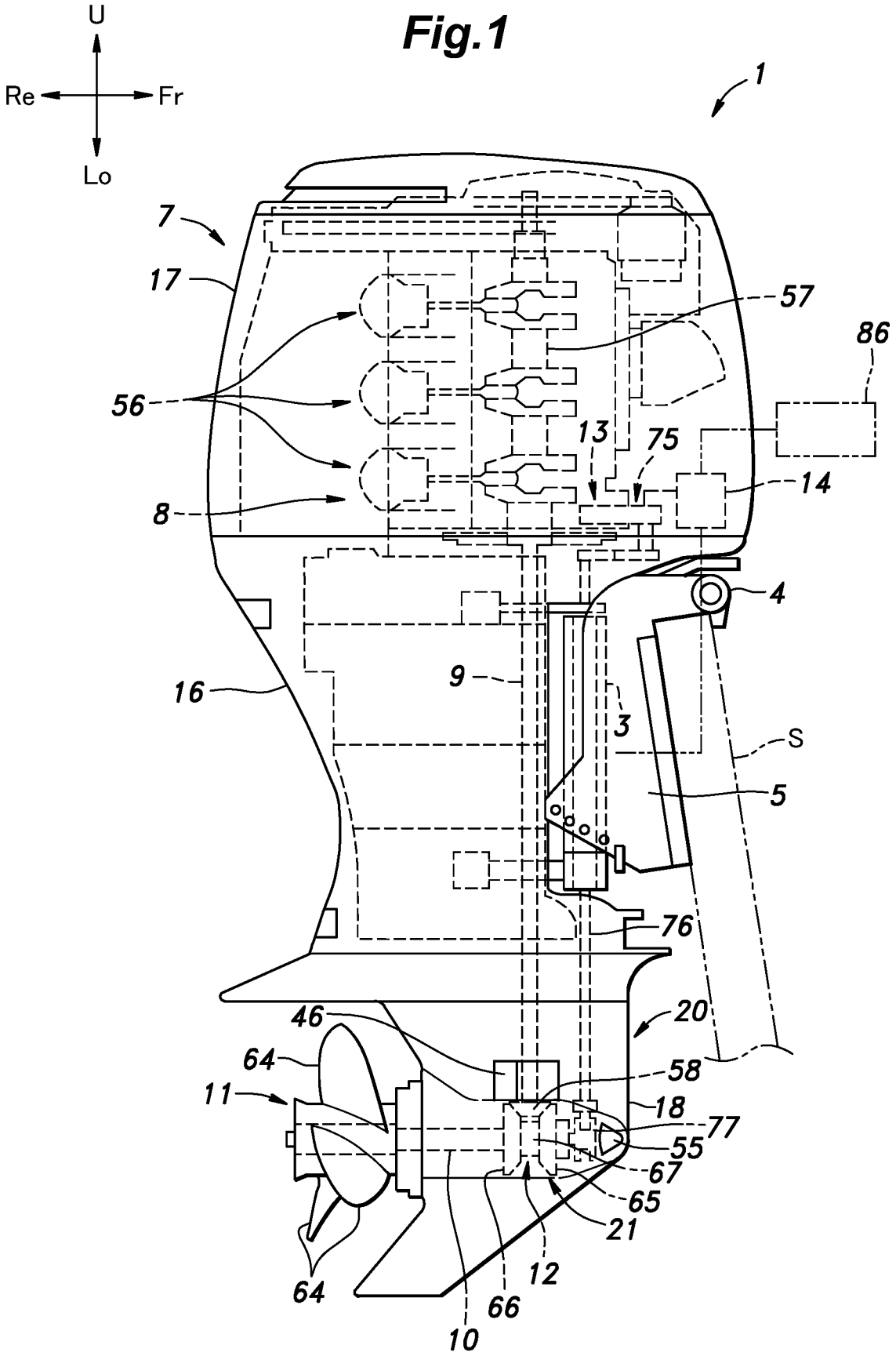
FIG. 1 is a side view showing an outboard motor according to an embodiment of the present invention.

With reference to FIG. 1, the outboard motor 1 is attached to the stern of a hull S in order to promote the hull S according to an operation by a crew (operator). The outboard motor 1 is configured to turn left and right around a swivel shaft 3 and turn up and down around a tilt shaft 4. A tilt mechanism 5 is provided in front of the swivel shaft 3. The tilt mechanism 5 turns the outboard motor 1 around the tilt shaft 4 by using an electric motor or a hydraulic cylinder, thereby changing a tilt angle of the outboard motor 1 with respect to the hull S.

The outboard motor 1 includes an outboard motor body 7, an engine 8 (an example of a drive device), a driveshaft 9, a propeller shaft 10, a propeller 11, a gear device 12, a shift device 13, and a control device 14. In the following, these components of the outboard motor 1 will be described one by one.

<Outboard Motor Body 7>

With reference to FIG. 1, the outboard motor body 7 has a box-like shape elongated in the up-and-down direction. The outboard motor body 7 includes a main case 16, an upper case 17 arranged above the main case 16, and a lower case 18 arranged below the main case 16. The main case 16, the upper case 17, and the lower case 18 are provided separately from each other.

The main case 16 and an upper portion of the lower case 18 constitute a driveshaft housing 20. The driveshaft housing 20 has a flat shape elongated in the up-and-down direction. A central portion in the up-and-down direction of the lower case 18 constitutes a gear case 21. The gear case 21 has a bullet-like shape elongated in the front-and-rear direction. The gear case 21 is arranged below the driveshaft housing 20, and is continuous with the driveshaft housing 20. The gear case 21 bulges laterally with respect to the driveshaft housing 20.

Figure 2:
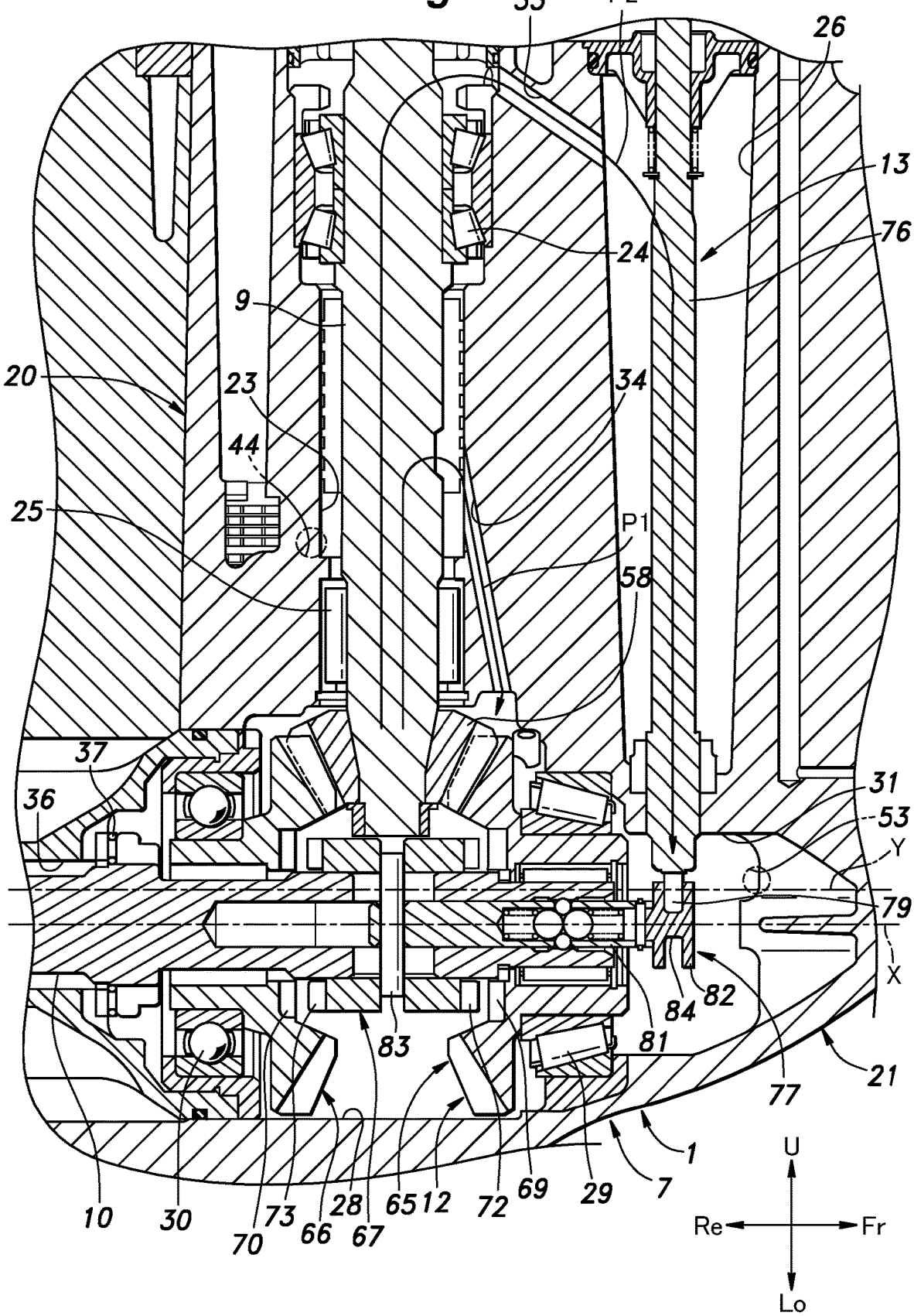
FIG. 2 is a cross-sectional view showing a driveshaft and its periphery according to the embodiment of the present invention.

With reference to FIG. 2, the driveshaft housing 20 is provided with a first shaft chamber 23 extending in the up-and-down direction. A pair of upper and lower bearings 24 and 25 (an upper bearing 24 and a lower bearing 25) are accommodated in the first shaft chamber 23. The driveshaft housing 20 is provided with a second shaft chamber 26 arranged in front of the first shaft chamber 23 and extending in the up-and-down direction.

The gear case 21 is provided with a gear chamber 28 extending in the front-and-rear direction. An upper end of the gear chamber 28 communicates with a lower end of the first shaft chamber 23. A pair of front and rear bearings 29 and 30 (a front bearing 29 and a rear bearing 30) are accommodated in the gear chamber 28. The gear case 21 is provided with a shift chamber 31 arranged in front of the gear chamber 28. A rear end of the shift chamber 31 communicates with a front end of the gear chamber 28. An upper end of the shift chamber 31 communicates with a lower end of the second shaft chamber 26.

The driveshaft housing 20 is provided with an upper communication hole 33 through which the first shaft chamber 23 and the second shaft chamber 26 communicate with each other. The upper communication hole 33 inclines downward from a rear side (a side of the first shaft chamber 23) to a front side (a side of the second shaft chamber 26). A rear end (an end on the side of the first shaft chamber 23) of the upper communication hole 33 is arranged higher than the upper bearing 24. The driveshaft housing 20 is provided with a lower communication hole 34 through which the first shaft chamber 23 and the gear chamber 28 communicate with each other. The lower communication hole 34 inclines forward from an upper side (a side of the first shaft chamber 23) to a lower side (a side of the gear chamber 28). An upper end (an end on the side of the first shaft chamber 23) of the lower communication hole 34 is arranged between the upper bearing 24 and the lower bearing 25.

Lubricating oil is held in the gear chamber 28 and the shift chamber 31 of the gear case 21. The height Y of a liquid level of the lubricating oil is arranged lower than a lower end of the driveshaft 9. The driveshaft housing 20 is provided with a first oil passage P1 and a second oil passage P2. The first oil passage P1 is a passage extending from the gear chamber 28 and returning thereto via the lower bearing 25 and the lower communication hole 34. The second oil passage P2 is a passage extending from the gear chamber 28 and leading to the shift chamber 31 via the lower bearing 25, the upper bearing 24, the upper communication hole 33, and the second shaft chamber 26.

Figure 3:
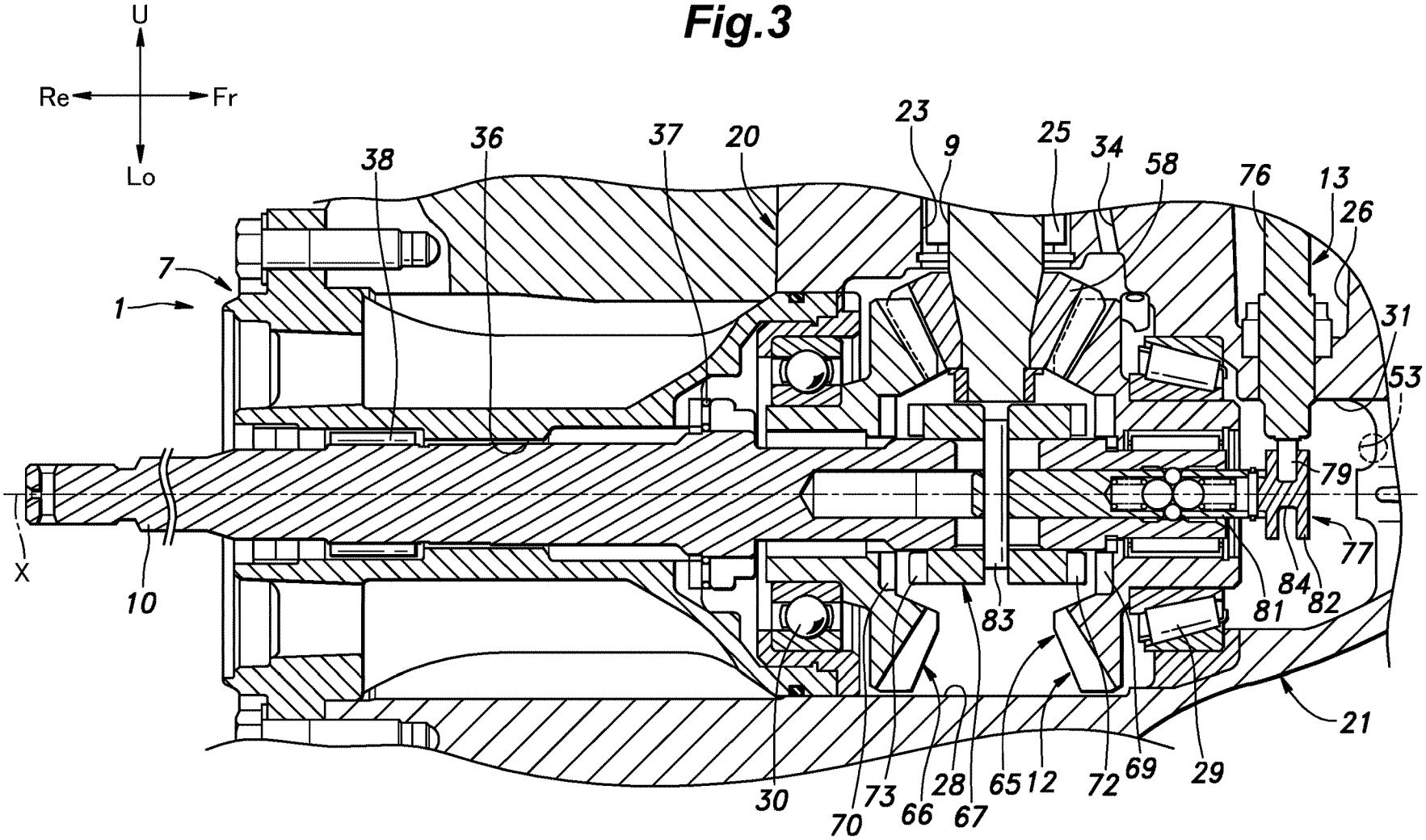
FIG. 3 is a cross-sectional view showing a propeller shaft and its periphery according to the embodiment of the present invention.

With reference to FIG. 3, the gear case 21 is provided with a support hole 36 arranged at the rear of the gear chamber 28. The support hole 36 extends in the front-and-rear direction from a rear end of the gear chamber 28 to a rear end surface of the gear case 21. A first bearing 37 is accommodated in a front portion of the support hole 36. For example, the first bearing 37 consists of a thrust bearing. A second bearing 38 is accommodated in a rear portion of the support hole 36. For example, the second bearing 38 consists of a needle bearing. The first bearing 37 and the second bearing 38 are spaced at an interval in the front-and-rear direction.

Figure 4:
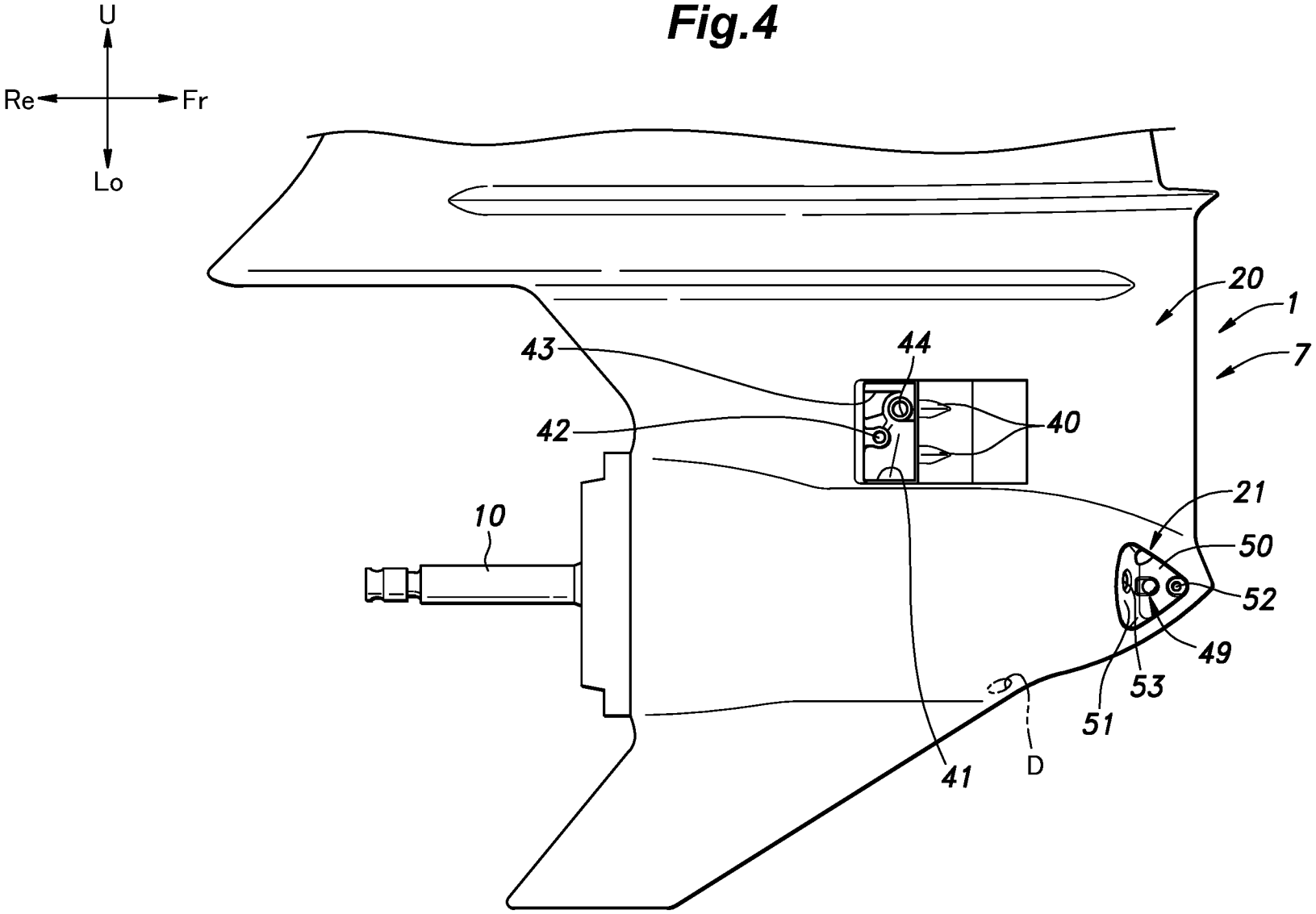
FIG. 4 is a side view showing a state where the outboard motor is not tilted according to the embodiment of the present invention.

With reference to FIG. 4, a pair of upper and lower ribs 40 protrudes from a central portion in the front-and-rear direction of a side surface of the driveshaft housing 20. At the central portion in the front-and-rear direction of the side surface of the driveshaft housing 20, a side recess 41, which has a rectangular shape elongated in the up-and-down direction, is provided at the rear of the pair of upper and lower ribs 40. A cylindrical attachment boss 42 is provided at a central portion in the up-and-down direction of the side recess 41. At a rear upper portion of the side recess 41, a water inlet 43 for introducing cooling water into the outboard motor 1 is opened. The water inlet 43 communicates with a water supply passage (not shown) provided inside the outboard motor 1. At a front upper portion of the side recess 41, an introduction port 44 for introducing the lubricating oil into the gear case 21 is opened. The introduction port 44 is closed by a bolt (not shown). The introduction port 44 is provided in front of the water inlet 43 so as to be next to the water inlet 43. Namely, a position in the up-and-down direction of the introduction port 44 overlaps with a position in the up-and-down direction of the water inlet 43. With reference to FIG. 2, the introduction port 44 is arranged lower than the upper bearing 24 and higher than the lower bearing 25, and communicates with the first shaft chamber 23 of the driveshaft housing 20.

With reference to FIGS. 1 and 4, the water inlet 43 and the introduction port 44 of the driveshaft housing 20 are covered with a filter 46. For example, the filter 46 consists of a mesh filter. The filter 46 is attached to the side recess 41 of the driveshaft housing 20 via a bolt (not shown) that engages with the attachment boss 42 of the driveshaft housing 20.

With reference to FIG. 4, a front recess 49 is provided on a front end side of a side surface of the gear case 21. The front recess 49 has a side surface 50 extending in the front-and-rear direction and a rear surface 51 extending laterally outward from a rear end of the side surface 50. An attachment hole 52 is provided on a front end side of the side surface 50. In the center of the rear surface 51, a confirmation port 53 for causing the lubricating oil introduced into the gear case 21 to flow out is opened. The confirmation port 53 is closed by a bolt (not shown). With reference to FIG. 2, the confirmation port 53 is arranged higher than an axis X of the propeller shaft 10 and lower than the upper end of the gear chamber 28, and communicates with a front upper portion of the shift chamber 31 of the gear case 21. In another embodiment, the confirmation port 53 may be arranged at the same height as the axis X of the propeller shaft 10, or may be arranged lower than the axis X of the propeller shaft 10.

With reference to FIGS. 1 and 4, the confirmation port 53 of the gear case 21 is covered with a cover 55 configured to close the front recess 49. The cover 55 is fixed to the front end side of the gear case 21 via a bolt (not shown) that engages with the attachment hole 52 of the gear case 21. An outer surface of the cover 55 is curved along an outer surface of the gear case 21.

<Engine 8>

With reference to FIG. 1, the engine 8 is accommodated in the upper case 17 of the outboard motor body 7. The engine 8 is, for example, a V-type engine having a plurality of cylinders 56 aligned in the up-and-down direction. In another embodiment, the engine 8 may be a multicylinder engine other than a V-type engine, or may be an engine with a single cylinder. The engine 8 has a rotatable crankshaft 57 (an example of a driving shaft). An axis of the crankshaft 57 extends in the up-and-down direction.

<Driveshaft 9>

With reference to FIGS. 1 and 2, the driveshaft 9 extends in the up-and-down direction below the engine 8. An upper end of the driveshaft 9 is connected to the crankshaft 57 of the engine 8. A drive gear 58 is provided at a lower end of the driveshaft 9. The driveshaft 9 is accommodated in the first shaft chamber 23 of the driveshaft housing 20, and is rotatably supported by the pair of upper and lower bearings 24 and 25.

<Propeller Shaft 10>

With reference to FIG. 3, the propeller shaft 10 extends in the front-and-rear direction (the horizontal direction) below the driveshaft 9. Namely, an axial direction of the propeller shaft 10 is the front-and-rear direction. A front portion of the propeller shaft 10 is accommodated in the gear chamber 28 of the gear case 21. A central portion in the front-and-rear direction of the propeller shaft 10 penetrates through the support hole 36 of the gear case 21, and is rotatably supported by the first and second bearings 37, 38. A rear portion of the propeller shaft 10 protrudes more rearward than a rear end of the gear case 21, and is exposed to an outside (namely, an outside of the outboard motor 1).

<Propeller 11>

With reference to FIG. 1, the propeller 11 is fixed to an outer circumference of a rear portion of the propeller shaft 10. The propeller 11 is arranged more rearward than the rear end of the gear case 21, and is exposed to the outside of the outboard motor 1. A plurality of fins 64 protrudes from an outer circumferential surface of the propeller 11. Incidentally, the propeller 11 is omitted in the drawings other than FIG. 1.

<Gear Device 12>

With reference to FIGS. 2 and 3, the gear device 12 is provided between the driveshaft 9 and the propeller shaft 10. The gear device 12 is a device configured to transmit the rotation of the driveshaft 9 to the propeller shaft 10 while converting a rotational axis direction from the up-and-down direction to the front-and-rear direction (horizontal direction). The gear device 12 is accommodated in the gear chamber 28 of the gear case 21. The gear device 12 includes a forward gear 65 and a reverse gear 66 facing each other and a clutch gear 67 arranged between the forward gear 65 and the reverse gear 66.

The forward gear 65 and the reverse gear 66 are provided on an outer circumference of the propeller shaft 10, and are arranged at an interval in the front-and-rear direction. The forward gear 65 is rotatably supported by the front bearing 29, and the reverse gear 66 is rotatably supported by the rear bearing 30. The forward gear 65 and the reverse gear 66 always mesh with the drive gear 58 of the driveshaft 9. The forward gear 65, the reverse gear 66, and the drive gear 58 of the driveshaft 9 compose a bevel gear mechanism. A front driving pawl 69 is provided on an inner surface of the forward gear 65, and a rear driving pawl 70 is provided on an inner surface of the reverse gear 66.

The clutch gear 67 is attached to an outer circumference of the propeller shaft 10. The clutch gear 67 is configured to move in the front-and-rear direction with respect to the propeller shaft 10 and rotate integrally with the propeller shaft 10. A front driven pawl 72, which can mesh with the front driving pawl 69 of the forward gear 65, is provided on a front surface of the clutch gear 67. A rear driven pawl 73, which can mesh with the rear driving pawl 70 of the reverse gear 66, is provided on a rear surface of the clutch gear 67.

<Shift Device 13>

With reference to FIGS. 1 and 2, the shift device 13 includes a shift mechanism 75, a shift shaft 76 connected to the shift mechanism 75 via a link mechanism (not shown), and a shift slider 77 (shift member) extending in the front-and-rear direction below the shift shaft 76.

The shift mechanism 75 is accommodated in the upper case 17 of the outboard motor body 7. For example, the shift mechanism 75 includes a shift motor and a shift rod connected to the shift motor.

The shift shaft 76 extends in the up-and-down direction so as to be parallel to the driveshaft 9. The shift shaft 76 is accommodated in the second shaft chamber 26 of the driveshaft housing 20. An engagement pin 79 is provided at a lower end of the shift shaft 76. The engagement pin 79 is arranged eccentrically with respect to a rotational center of the shift shaft 76, and is configured to move in the front-and-rear direction according to the rotation of the shift shaft 76.

The shift slider 77 includes a slider body 81 extending in the front-and-rear direction and an engagement piece 82 (engagement portion) fixed to a front end of the slider body 81. The slider body 81 is coupled to the clutch gear 67 via a coupling pin 83. Accordingly, the shift slider 77 is configured to move integrally with the clutch gear 67 in the front-and-rear direction. The engagement piece 82 is accommodated in the shift chamber 31 of the gear case 21. An annular engagement groove 84 is provided on an outer circumferential surface of the engagement piece 82, and the engagement pin 79 of the shift shaft 76 engages with the engagement groove 84.

<Control Device 14>

The control device 14 consists of an electronic control unit (ECU). The control device 14 is connected to an input device 86 provided in the hull S. The input device 86 is a device configured to accept an input operation by the crew. The control device 14 is connected to the tilt mechanism 5 and the shift mechanism 75.

<Operations of Gear Device 12 and Shift Device 13>

When the crew performs the input operation on the input device 86, an electric signal corresponding to this input operation is transmitted from the input device 86 to the control device 14. The control device 14 activates the shift mechanism 75 in response to the electrical signal from the input device 86.

For example, when the crew performs a forward shift operation (an operation for switching a shift position of the gear device 12 from "neutral" to "forward") on the input device 86, a forward shift signal corresponding to the forward shift operation is transmitted from the input device 86 to the control device 14. Accordingly, the control device 14 activates the shift mechanism 75 in response to the forward shift signal so as to rotate the shift shaft 76 connected to the shift mechanism 75, and thus the engagement pin 79 of the shift shaft 76 and the shift slider 77 move forward. Accordingly, the shift slider 77 pushes the clutch gear 67 forward via the coupling pin 83 so as to move the clutch gear 67 forward, and thus the front driven pawl 72 of the clutch gear 67 and the front driving pawl 69 of the forward gear 65 mesh with each other. Accordingly, the shift position of the gear device 12 is switched from "neutral" to "forward".

For example, when the crew performs a reverse shift operation (an operation for switching the shift position of the gear device 12 from "neutral" to "reverse") on the input device 86, a reverse shift signal corresponding to the reverse shift operation is transmitted from the input device 86 to the control device 14. Accordingly, the control device 14 activates the shift mechanism 75 in response to the reverse shift signal so as to rotate the shift shaft 76 connected to the shift mechanism 75, and thus the engagement pin 79 of the shift shaft 76 and the shift slider 77 move rearward. Accordingly, the shift slider 77 pushes the clutch gear 67 rearward via the coupling pin 83 so as to move the clutch gear 67 rearward, and thus the rear driven pawl 73 of the clutch gear 67 and the rear driving pawl 70 of the reverse gear 66 mesh with each other. Accordingly, the shift position of the gear device 12 is switched from "neutral" to "reverse".

Incidentally, when the crew performs a neutral shift operation (an operation for switching the shift position of the gear device 12 from "forward" or "reverse" to "neutral") on the input device 86, the gear device 12 and the shift device 13 operate in an opposite manner to the above operation. Accordingly, the shift position of the gear device 12 is switched from "forward" or "reverse" to "neutral".

<Operation of Outboard Motor 1>

When the engine 8 starts, the crankshaft 57 of the engine 8 rotates, and thus the driveshaft 9 connected to the crankshaft 57 rotates. Accordingly, the rotation of the driveshaft 9 is transmitted to the forward gear 65 and the reverse gear 66, and thus the forward gear 65 and the reverse gear 66 rotate in the directions opposite to each other.

In a case where the front driven pawl 72 of the clutch gear 67 and the front driving pawl 69 of the forward gear 65 engage with each other (in a case where the shift position of the gear device 12 is "forward"), the rotation of the forward gear 65 is transmitted to the propeller shaft 10 via the clutch gear 67, and the propeller shaft 10 and the propeller 11 rotate in one direction. Accordingly, the forward propulsion is applied to the hull S, and thus the hull S moves forward.

On the other hand, in a case where the rear driven pawl 73 of the clutch gear 67 and the rear driving pawl 70 of the reverse gear 66 engage with each other (in a case where the shift position of the gear device 12 is "reverse"), the rotation of the reverse gear 66 is transmitted to the propeller shaft 10 via the clutch gear 67, and the propeller shaft 10 and the propeller 11 rotate in a direction opposite to the above one direction. Accordingly, the rearward propulsion is applied to the hull S, and thus the hull S moves rearward.

Incidentally, in a case where the front driven pawl 72 of the clutch gear 67 and the front driving pawl 69 of the forward gear 65 do not mesh with each other and the rear driven pawl 73 of the clutch gear 67 and the rear driving pawl 70 of the reverse gear 66 do not mesh with each other (in a case where the shift position of the gear device 12 is "neutral"), the rotation of the forward gear 65 and the reverse gear 66 is not transmitted to the propeller shaft 10 via the clutch gear 67, and thus the propeller shaft 10 and the propeller 11 do not rotate. Accordingly, the propulsion is not applied to the hull S, and thus the hull S is stopped.

<Cooling and Lubrication Inside Outboard Motor 1>

When the driveshaft 9 rotates as described above, a water pump (not shown) provided on an outer circumference of the driveshaft 9 rotates integrally with the driveshaft 9. Accordingly, the cooling water outside the outboard motor 1 is introduced into the outboard motor 1 via the water inlet 43. The cooling water introduced into the outboard motor 1 is sent by the water pump through the water supply passage (not shown) from a lower side to an upper side, and flows into the upper case 17 so as to cool the engine 8 and its periphery. The cooling water that has cooled the engine 8 and its periphery is discharged to the outside of the outboard motor 1 via a water discharge passage (not shown).

Further, when the forward gear 65 and the reverse gear 66 rotate as described above, the lubricating oil in the gear chamber 28 is lifted by the forward gear 65 and the reverse gear 66. A portion of the lubricating oil lifted by the forward gear 65 and the reverse gear 66 rises in the first shaft chamber 23 along the rotating driveshaft 9, and returns to the gear chamber 28 via the lower communication hole 34 after passing through the lower bearing 25. Namely, the portion of the lubricating oil lifted by the forward gear 65 and the reverse gear 66 passes through the first oil passage P1, and then returns to the gear chamber 28.

On the other hand, the other portion of the lubricating oil lifted by the forward gear 65 and the reverse gear 66 rises in the first shaft chamber 23 along the rotating driveshaft 9, and flows into the second shaft chamber 26 through the upper communication hole 33 after passing through the lower bearing 25 and the upper bearing 24. The lubricating oil that has flowed into the second shaft chamber 26 falls through the second shaft chamber 26, and then flows into the shift chamber 31. Namely, the other portion of the lubricating oil lifted by the forward gear 65 and the reverse gear 66 passes through the second oil passage P2, and then flows into the shift chamber 31.

Incidentally, in order to sufficiently secure the amount of the lubricating oil that rises along the driveshaft 9, a structure (for example, a spiral groove) for promoting the rise of the lubricating oil may be provided on the outer circumferential surface of the driveshaft 9.

<Lubricating Oil Introducing Operation>

Next, an example of an operation (hereinafter referred to as "the lubricating oil introducing operation") for introducing the lubricating oil inside the gear case 21 will be described. Incidentally, it is assumed that the outboard motor 1 is not tilted (see FIG. 4) at the start of the lubricating oil introducing operation.

First, a worker (for example, the crew) in charge of the lubricating oil introducing operation performs a tilt mode start operation (an operation for giving an instruction to start a tilt mode) on the input device 86. Accordingly, a tilt mode start signal corresponding to the tilt mode start operation is transmitted from the input device 86 to the control device 14. Upon receiving the tilt mode start signal, the control device 14 starts the tilt mode after confirming that the engine 8 is stopped.

Upon starting the tilt mode, the control device 14 sets a recommended tilt angle of the outboard motor 1. For example, the control device 14 may set the recommended tilt angle to a constant value according to the model and size of the outboard motor 1. Alternatively, the control device 14 may change the recommended tilt angle according to the usage period of the outboard motor 1, the number of times the lubricating oil is introduced, and the like.

Figure 5:
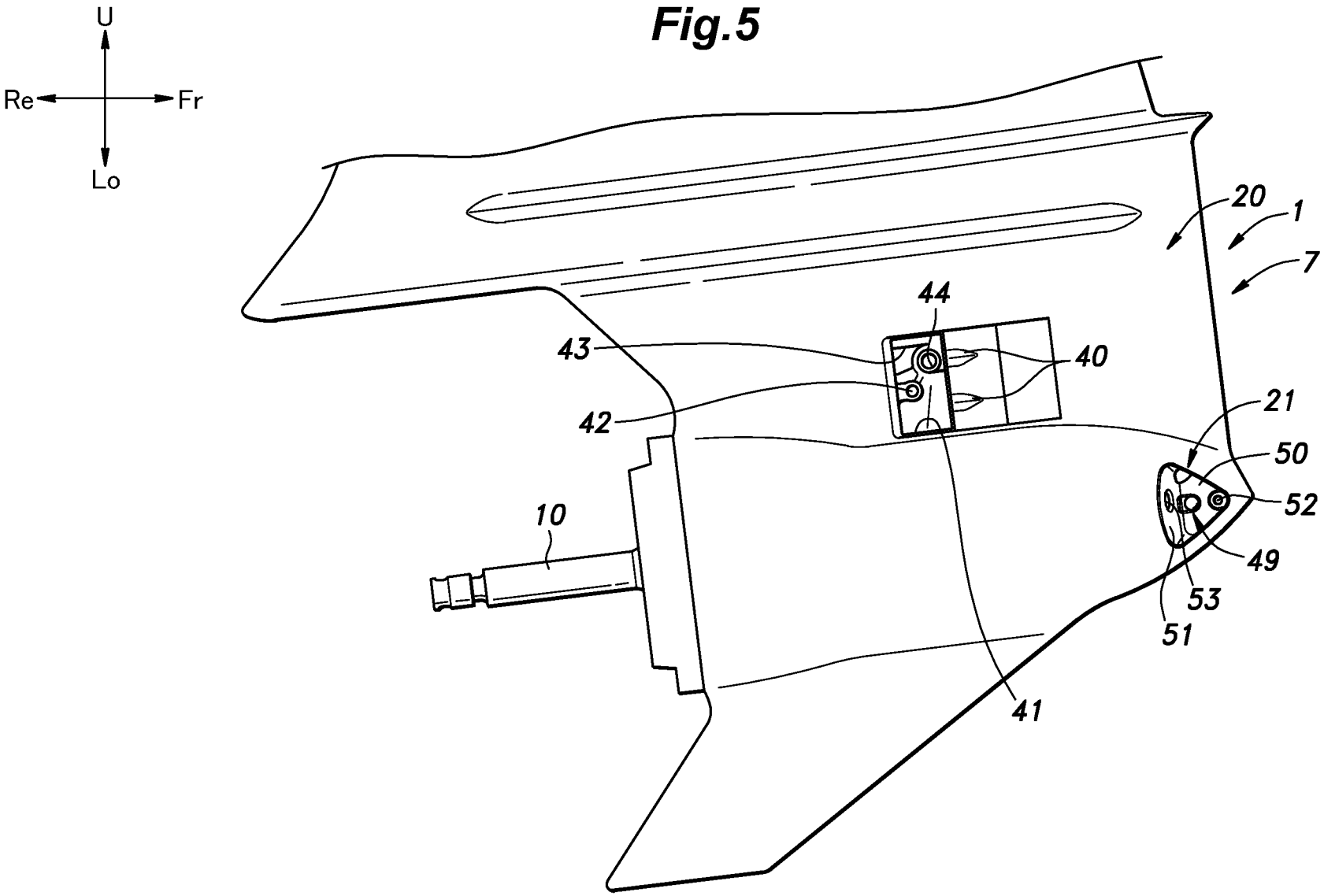
FIG. 5 is a side view showing a state where the outboard motor is tilted according to the embodiment of the present invention.

Next, the control device 14 causes the tilt mechanism 5 to tilt the outboard motor 1 such that the tilt angle of the outboard motor 1 matches the recommended tilt angle. For example, as shown in FIG. 5, the control device 14 may cause the tilt mechanism 5 to tilt the outboard motor 1 such that the propeller shaft 10 is tilted upward from the rear to the front. Accordingly, the confirmation port 53 is positioned higher as compared with a state where the outboard motor 1 is not tilted (see FIG. 4), so that the introduction amount of the lubricating oil increases. Alternatively, the control device 14 may cause the tilt mechanism 5 to tilt the outboard motor 1 such that the propeller shaft 10 is tilted downward from the rear to the front. Accordingly, the confirmation port 53 is positioned lower as compared with a state where the outboard motor 1 is not tilted (see FIG. 4), so that the introduction amount of the lubricating oil decreases.

When the outboard motor 1 is tilted in this way, the worker removes the filter 46 from the driveshaft housing 20, and then removes a bolt (not shown) that closes the introduction port 44 of the driveshaft housing 20 so as to open the introduction port 44. Also, the worker removes the cover 55 from the gear case 21, and then removes a bolt (not shown) that closes the confirmation port 53 of the gear case 21 so as to open the confirmation port 53.

Next, the worker introduces the lubricating oil from the introduction port 44. The lubricating oil introduced from the introduction port 44 flows into the gear chamber 28 via the first shaft chamber 23. A portion of the lubricating oil that has flowed into the gear chamber 28 flows from the gear chamber 28 to the shift chamber 31 and the support hole 36. After a certain period of time has passed from the start of the introduction of the lubricating oil, the amount of the lubricating oil inside the gear case 21 reaches a prescribed amount, and thus the lubricating oil flows from the confirmation port 53 communicating with the shift chamber 31 to the outside of the outboard motor 1. After confirming that the lubricating oil flows out from the confirmation port 53, the worker stops the introduction of the lubricating oil from the introduction port 44.

Next, the worker attaches the cover 55 to the gear case 21 after closing the confirmation port 53 of the gear case 21 by a bolt. Further, the worker attaches the filter 46 to the driveshaft housing 20 after closing the introduction port 44 of the driveshaft housing 20 by a bolt.

Next, the worker performs a tilt mode end operation (an operation to give an instruction to end the tilt mode) on the input device 86. Accordingly, a tilt mode end signal corresponding to the tilt mode end operation is transmitted from the input device 86 to the control device 14. Upon receiving the tilt mode end signal, the control device 14 causes the tilt mechanism 5 to return the outboard motor 1 to the state where the outboard motor 1 is not tilted (see FIG. 4) (namely, the tilt mechanism 5 sets the tilt angle of the outboard motor 1 to zero). When the outboard motor 1 returns to the state where the outboard motor 1 is not tilted, the control device 14 ends the tilt mode. Accordingly, the lubricating oil introducing operation is completed.

Incidentally, in a case where an operation of discharging the lubricating oil from the gear case 21 is performed, the outboard motor 1 is tilted such that the propeller shaft 10 is tilted downward from the rear to the front in a state where the introduction port 44 and the confirmation port 53 are opened. Accordingly, the lubricating oil is discharged from the confirmation port 53. At this time, the introduction port 44 functions as an air introduction port for introducing air into the outboard motor 1, and the confirmation port 53 functions as a discharge port for discharging the lubricating oil. In another embodiment, a discharge port for discharging the lubricating oil may be provided separately from the confirmation port 53 at a lower portion (for example, a portion indicated by a circle D in FIG. 4) of the gear case 21. In this case, it is not necessary to tilt the outboard motor 1 when performing the operation of discharging the lubricating oil from the gear case 21.

<Effects>

As described above, the introduction port 44 for introducing the lubricating oil into the gear case 21 is opened on the driveshaft housing 20, and the confirmation port 53 for causing the lubricating oil introduced into the gear case 21 to flow out is opened on the front end side of the gear case 21. According to this configuration, the introduction port 44 is arranged higher than the confirmation port 53, so that the lubricating oil introduced from the introduction port 44 can reach the confirmation port 53 by gravity. Accordingly, when the lubricating oil is introduced, a mechanism (for example, a pump) for sending the lubricating oil from a lower side to an upper side is unnecessary, so that the lubricating oil introducing operation can be simplified and the required time thereof can be shortened. Further, by arranging the introduction port 44 higher than the gear case 21, it is possible to prevent the lubricating oil from leaking from the introduction port 44 in a period after completing the introduction of the lubricating oil into the gear case 21 and before closing the introduction port 44. Accordingly, an appropriate amount of the lubricating oil can be introduced into the gear case 21. Furthermore, by stopping the introduction of the lubricating oil from the introduction port 44 when the lubricating oil flows out from the confirmation port 53, it is possible to introduce an appropriate amount of the lubricating oil into the gear case 21 without weighing the lubricating oil in advance.

Further, the amount of the lubricating oil introduced into the outboard motor 1 can be reduced as compared with a case where the lubricating oil is introduced into the entire gear case 21 and a portion of the driveshaft housing 20. Accordingly, when a plurality of gears (the forward gear 65, the reverse gear 66, and the clutch gear 67) of the gear device 12 and the driveshaft 9 rotate, the frictional resistance (viscous resistance) due to the lubricating oil can be reduced, and the decrease in the output of the engine 8 can be suppressed. Further, it is possible to perform the lubricating oil introducing operation without removing the propeller 11, so that the lubricating oil introducing operation can be further simplified and the required time thereof can be further shortened.

Further, the side recess 41 is provided on the side surface of the driveshaft housing 20, the water inlet 43 is opened inside the side recess 41, and the introduction port 44 is opened inside the side recess 41 so as to be next to the water inlet 43. According to this configuration, since the water inlet 43 and the introduction port 44 are opened inside one recess, it is possible to suppress an increase in the number of recesses formed on the side surface of the driveshaft housing 20. Accordingly, the water flow outside the outboard motor 1 can be smoothed.

Further, the water inlet 43 is covered with the filter 46, so that it is possible to prevent a foreign object from entering the outboard motor 1 during water supply.

Further, the confirmation port 53 is arranged higher than the axis X of the propeller shaft 10 and lower than the upper end of the gear chamber 28 so as to function as a discharge port for discharging the lubricating oil. Accordingly, the number of portions to be processed can be reduced as compared with a case where the confirmation port 53 and the discharge port of the lubricating oil are processed separately.

Further, the confirmation port 53 is opened inside the front recess 49 and covered with the cover 55 configured to close the front recess 49. According to this configuration, the shape of the front end side of the gear case 21, which is subject to large water pressure, can be smoothed. Accordingly, the water flow outside the outboard motor 1 can be smoothed.

Further, the driveshaft housing 20 is provided with the first oil passage P1 extending from the gear chamber 28 and returning thereto via the lower bearing 25 and the second oil passage P2 extending from the gear chamber 28 and leading to the shift chamber 31 via the lower bearing 25, the upper bearing 24, and the second shaft chamber 26. According to this configuration, even if the lubricating oil is not introduced up to an upper end of the gear case 21, the lubricating oil can be sufficiently distributed to the gear chamber 28, the shift chamber 31, and the first and second shaft chambers 23, 26. Accordingly, the members (for example, the gear device 12, the shift shaft 76, the shift slider 77, the upper bearing 24, the lower bearing 25, and the like) arranged in the gear chamber 28, the shift chamber 31, and the first and second shaft chambers 23, 26 can be lubricated quickly and sufficiently.

Further, the introduction port 44 communicates with the first shaft chamber 23, and the confirmation port 53 communicates with the shift chamber 31. According to this configuration, the lubricating oil flows out from the confirmation port 53 after a sufficient amount of the lubricating oil is introduced into the gear chamber 28 and the shift chamber 31. Accordingly, the members arranged in the gear chamber 28, the shift chamber 31, and the first and second shaft chambers 23, 26 can be lubricated more effectively.

Further, the lubricating oil introducing method for the outboard motor 1 according to the present embodiment includes: opening the introduction port 44 and the confirmation port 53; introducing the lubricating oil from the introduction port 44; stopping introduction of the lubricating oil from the introduction port 44 after confirming that the lubricating oil flows out from the confirmation port 53; and closing the confirmation port 53. Accordingly, the lubricating oil introducing operation can be simplified and the required time thereof can be shortened. Also, an appropriate amount of the lubricating oil can be introduced into the gear case 21.

Further, in the lubricating oil introducing method according to the present embodiment, the lubricating oil is introduced from the introduction port 44 in a state where the outboard motor 1 is tilted. Accordingly, it is possible to adjust or limit the amount of the lubricating oil introduced into the gear case 21 by using a simple method.

Further, the lubricating oil introducing method according to the present embodiment further includes: setting the recommended tilt angle of the outboard motor 1 before introducing the lubricating oil from the introduction port 44, and controlling the tilt angle of the outboard motor 1 such that the tilt angle of the outboard motor 1 matches the recommended tilt angle of the outboard motor 1 before introducing the lubricating oil from the introduction port 44. Accordingly, the worker can tilt the outboard motor 1 at an appropriate angle without tilting the outboard motor 1 by himself/herself. Accordingly, the lubricating oil introducing operation can be simplified.

Concrete embodiments of the present invention have been described in the foregoing, but the present invention should not be limited by the foregoing embodiments and various modifications and alterations are possible within the scope of the present invention.

The invention claimed is:

1. An outboard motor, comprising:

a drive device including a rotatable driving shaft;

a driveshaft extending in an up-and-down direction below the drive device and configured to rotate according to rotation of the driving shaft;

a propeller shaft extending horizontally below the driveshaft and configured to rotate according to rotation of the driveshaft;

a propeller fixed to the propeller shaft;

a gear device provided between the driveshaft and the propeller shaft and configured to transmit the rotation of the driveshaft to the propeller shaft;

a driveshaft housing configured to accommodate the driveshaft; and a gear case bulging laterally below the driveshaft housing and configured to accommodate the gear device, wherein an inside of the driveshaft housing communicates with an inside of the gear case, an introduction port for introducing lubricating oil into the gear case is opened on the driveshaft housing, and a confirmation port for causing the lubricating oil introduced into the gear case to flow out is opened on a front end side of the gear case, wherein the gear case is provided with a gear chamber configured to accommodate the gear device, and the confirmation port is arranged higher than an axis of the propeller shaft and lower than an upper end of the gear chamber so as to function as a discharge port for discharging the lubricating oil.

2. The outboard motor according to claim 1, wherein a side recess is provided on a side surface of the driveshaft housing, and a water inlet for introducing cooling water is opened inside the side recess, and the introduction port is opened inside the side recess so as to be next to the water inlet.

3. The outboard motor according to claim 2, wherein the water inlet is covered with a filter.

4. The outboard motor according to claim 1, wherein a front recess is provided on the front end side of the gear case, and the confirmation port is opened inside the front recess and covered with a cover configured to close the front recess.

5. An outboard motor, comprising:

a drive device including a rotatable driving shaft;

a driveshaft extending in an up-and-down direction below the drive device and configured to rotate according to rotation of the driving shaft;

a propeller shaft extending horizontally below the driveshaft and configured to rotate according to rotation of the driveshaft;

a propeller fixed to the propeller shaft;

a gear device provided between the driveshaft and the propeller shaft and configured to transmit the rotation of the driveshaft to the propeller shaft;

a driveshaft housing configured to accommodate the driveshaft;

a gear case bulging laterally below the driveshaft housing and configured to accommodate the gear device;

a shift shaft extending in the up-and-down direction so as to be parallel to the driveshaft; and a shift member configured to switch a shift position of the gear device according to rotation of the shift shaft and including an engagement portion engaging with a lower end of the shift shaft, wherein an inside of the driveshaft housing communicates with an inside of the gear case, an introduction port for introducing lubricating oil into the gear case is opened on the driveshaft housing, and a confirmation port for causing the lubricating oil introduced into the gear case to flow out is opened on a front end side of the gear case, wherein the driveshaft housing is provided with a first shaft chamber configured to accommodate the driveshaft and a second shaft chamber configured to accommodate the shift shaft, the driveshaft is supported by an upper bearing and a lower bearing that are accommodated in the first shaft chamber, the gear case is provided with a gear chamber configured to accommodate the gear device and a shift chamber configured to accommodate the engagement portion of the shift member, and the driveshaft housing is provided with a first oil passage extending from the gear chamber and returning thereto via the lower bearing and a second oil passage extending from the gear chamber and leading to the shift chamber via the lower bearing, the upper bearing, and the second shaft chamber.

6. The outboard motor according to claim 5, wherein the introduction port communicates with the first shaft chamber, and the confirmation port communicates with the shift chamber.

7. A lubricating oil introducing method of an outboard motor comprising:

a drive device including a rotatable driving shaft;

a driveshaft extending in an up-and-down direction below the drive device and configured to rotate according to rotation of the driving shaft;

a propeller shaft extending horizontally below the driveshaft and configured to rotate according to rotation of the driveshaft;

a propeller fixed to the propeller shaft;

a gear device provided between the driveshaft and the propeller shaft and configured to transmit the rotation of the driveshaft to the propeller shaft;

a driveshaft housing configured to accommodate the driveshaft; and a gear case bulging laterally below the driveshaft housing and configured to accommodate the gear device, wherein an inside of the driveshaft housing communicates with an inside of the gear case, an introduction port for introducing lubricating oil into the gear case is opened on the driveshaft housing, and a confirmation port for causing the lubricating oil introduced into the gear case to flow out is opened on a front end side of the gear case, the lubricating oil introducing method comprising:

opening the introduction port and the confirmation port;

introducing the lubricating oil from the introduction port;

stopping introduction of the lubricating oil from the introduction port after confirming that the lubricating oil flows out from the confirmation port; and closing the confirmation port.

8. The lubricating oil introducing method according to claim 7, wherein introducing the lubricating oil from the introduction port in a state where the outboard motor is tilted.

9. The lubricating oil introducing method according to claim 8, further comprising:

setting a recommended tilt angle of the outboard motor before introducing the lubricating oil from the introduction port, and controlling a tilt angle of the outboard motor such that the tilt angle of the outboard motor matches the recommended tilt angle of the outboard motor before introducing the lubricating oil from the introduction port.

* * * * *